United States Patent [19]

Lockhart

[11] Patent Number: 4,817,818

[45] Date of Patent: Apr. 4, 1989

[54] TAMPER-PROOF METHOD OF DISTRIBUTING AND RETAILING FOOD AND DRUG PRODUCTS

[76] Inventor: Walter R. Lockhart, 6331 Mesedge Dr., Colorado Springs, Colo. 80919

[21] Appl. No.: 80,339

[22] Filed: Jul. 31, 1987

[51] Int. Cl.[4] ..... A47F 1/08

[52] U.S. Cl. ..... 221/1; 221/154; 221/197; 221/310

[58] Field of Search ..... 221/1, 25, 154, 197, 221/198, 287, 302, 312 C, 306, 309–310; 220/210

[56] References Cited

U.S. PATENT DOCUMENTS

| | | | |
|---|---|---|---|
| 1,297,205 | 3/1919 | McLaren | 221/287 |
| 1,741,474 | 12/1929 | Moore | 221/287 X |
| 1,964,335 | 6/1934 | Wessman | 221/287 |
| 3,119,521 | 1/1964 | Taylor | 221/287 |
| 3,165,234 | 1/1965 | Conklin et al. | 221/302 |
| 3,973,687 | 8/1976 | Glick | 220/210 X |
| 4,579,250 | 4/1986 | Fuss et al. | 221/1 |

FOREIGN PATENT DOCUMENTS

| | | | |
|---|---|---|---|
| 2223764 | 10/1974 | France | 221/25 |

*Primary Examiner*—F. J. Bartuska
*Attorney, Agent, or Firm*—Gary M. Polumbus

[57] ABSTRACT

A method of dispensing food and drug products in a tamper-proof manner includes sealing the products within a tamper-proof container at the manufacturing and/or packaging site and not opening the container until it reaches the retail destination at which point a tamper-proof dispensing unit is attached to the container so that individual products can be removed from the container but cannot be reinserted into the container.

11 Claims, 4 Drawing Sheets

TAMPER-PROOF METHOD OF DISTRIBUTING AND RETAILING FOOD AND DRUG PRODUCTS

BACKGROUND OF THE INVENTION

1. Field Of The Invention

The present invention relates generally to the distribution and retail sales of products for human consumption such as food and drug products and, more particularly, to a tamper-proof method of distributing and selling such products.

2. Description Of The Prior Art

For many years food and drug products have been distributed and sold in an unprotected manner with the products typically being distributed in various types of containers which could be easily opened and closed without the knowledge of third parties. As a result of this type of distribution and sales, in recent years food and drug products have been tampered with at some stage in the manufacturing, distribution or sales process resulting in poisonous substances being incorporated into the products and unwary purchasers consuming the products.

In an attempt to preclude such tampering, containers, bottles, or the like are now being sealed by most companies to discourage tampering. This is done usually by providing closures for the containers, bottles, or the like which readily evidence tampering. In this manner, a consumer will theoretically be apprised of the fact that a bottle which he or she may be purchasing has been tampered with and should not be purchased or consumed.

However, sophisticated methods of tampering with products, even those sealed in newly designed tamper-proof bottles or the like, have been devised and allow one to inject lethal substances into the bottle as with a hypodermic needle, or to reseal a bottle that has been opened and tampered with in a manner such that a normal consumer would not be aware of the tampering.

Accordingly, while many attempts have been made at designing tamper-proof bottles or the like, they have not been totally satisfactory and the frequency of tampering with food and drug products continues to be a serious problem.

SUMMARY OF THE INVENTION

The present invention relates to a tamper-proof method of distributing and selling products for human consumption such as food and drug products, which method does not depend upon an individual tamper-proof bottle or the like, but rather an overall system of distribution and sale which prevents handling of the individual bottles or the like between the point of manufacture and the point of purchase by the consumer.

In accordance with the present invention, a carton or container having a plurality of bottles, cans or the like of the food product or drug to be distributed and sold is totally sealed in a tamper-proof manner so that any evidence of tampering with the carton is readily noticeable by any individual involved in the distribution and sales process. Each carton, however, includes a dispensing opening having a removable closure thereon which is either of the locking type that can be opened only with a key or known combination or of the type which once opened cannot again be closed. In this manner, if a carton arrives at a retail destination and the dispensing opening has been tampered with in any way, it will be readily apparent and products in that carton will not have to be sold. Once reaching the retail sales destination, however, a carton that has not been tampered with can be placed on a shelf accessible to the consuming public and equipped with a dispensing unit that dispenses individual bottles, cans or the like from the carton in a manner such that the bottle, can or the like can be removed from the carton but cannot be reinserted into the carton.

According to this method of distribution and sale, an individual bottle, can or the like cannot be removed from a carton, tampered with and replaced in the carton due to the fact that there is no way of reinserting the bottle, can or the like into the carton. Since many of the tampering occurrences to date have been a result of tampering at the retail location, this system for dispensing the products to the consuming public eliminates all such tamperings.

While the system would entail a different procedure for retail sales in that the bottles, cans or the like would not be exposed on a shelf as with current systems for retailing, they would be enclosed in a carton or other container which could have suitable advertising displayed on the faces thereof or through the use of samples which would be on display adjacent to the carton but not for sale. Accordingly, the consumer would be well apprised of the product which he or she wished to purchase and would be assured that the product had not been tampered with, which is not possible, or at least has not been achieved with current distribution and sales techniques.

Other aspects, features and details of the present invention can be more completely understood by reference to the following detailed description of a preferred embodiment, taken in conjunction with the drawings, and from the appended claims.

DETAILED DESCRIPTION OF THE PREFERRED EMBODIMENTS

Figure 1:
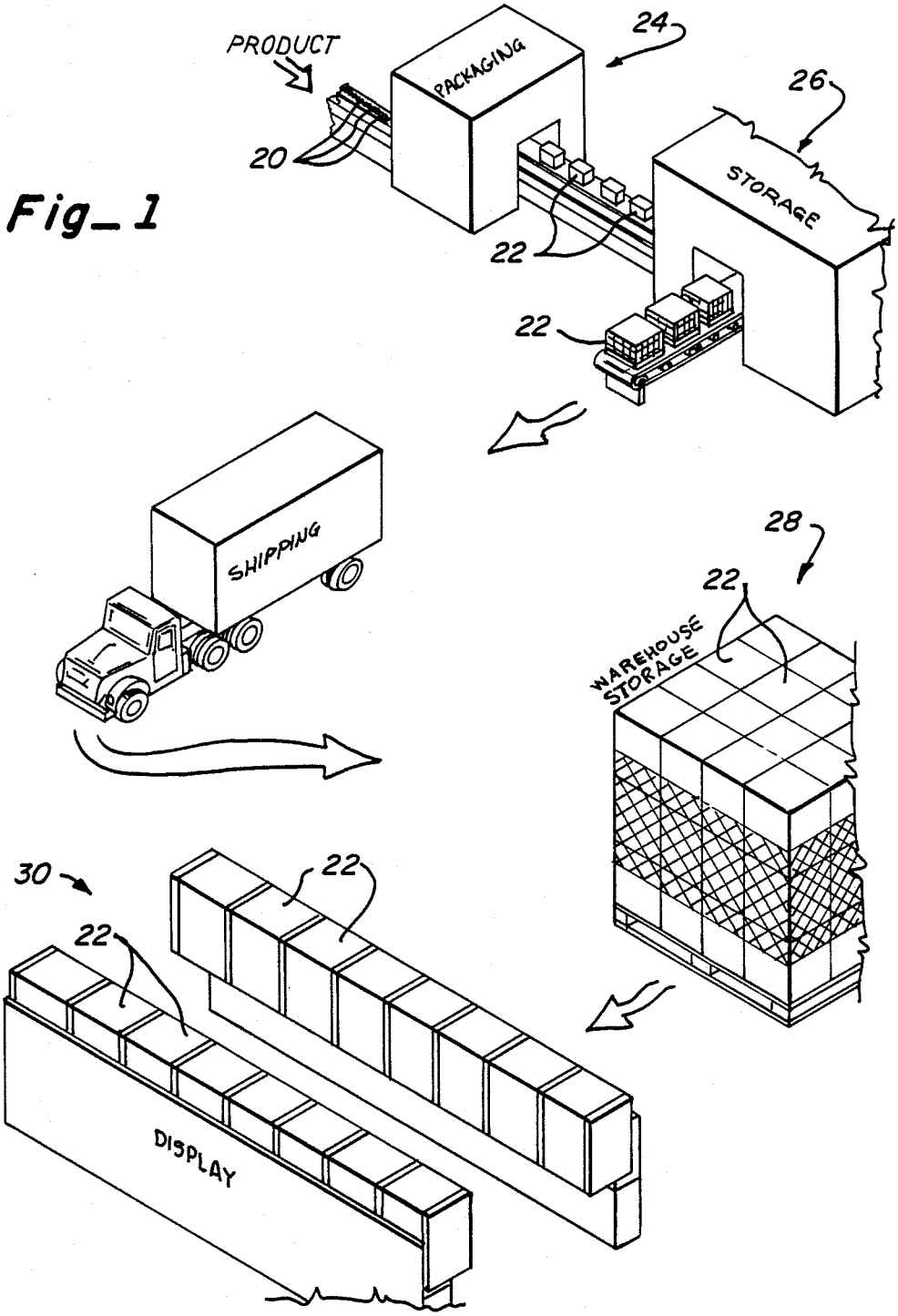
FIG. 1 is a diagrammatic perspective representation of a distribution and sales system showing packaging of individual products, storage of those products, shipping of the products to a warehouse location, and movement of the products from the warehouse location to a display case at a retail location.
Figure 8:
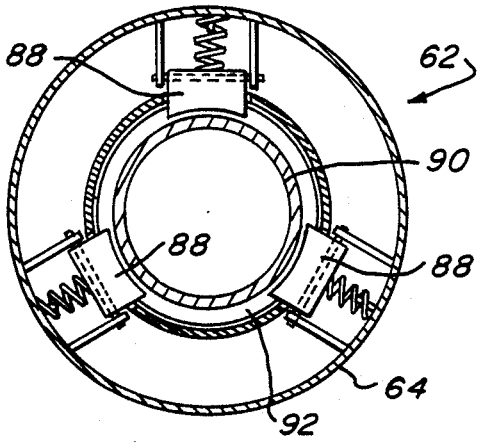
FIG. 8 is a section taken along line 8—8 of FIG. 7.

Referring first to FIG. 1, a diagrammatic representation is made of the method of the present invention for packaging, storing, shipping and finally displaying food and/or drug products for sale in a tamper-proof manner. The broad premise of the method or system of the present invention is to seal the bottled or otherwise packaged product in a container at the manufacturing and/or packaging site and retain the containers of product in a sealed condition until the product sealed therein is dispensed one at a time at the retail location. This process is illustrated in FIG. 1 wherein it is shown that the product 20 to be dispensed is packaged in a sealed container 22 as at a manufacturing and/or packaging site 24 and then transferred to a storage location 26 before being shipped to a distribution warehouse 28 or similar facility. From the warehouse, the goods are transferred to a retail location 30 and sold directly out of the sealed container 22 to the consuming public so that the product in the container can never be tampered with except in a manner in which the tampering could be easily detected before the products are sold.

Numerous systems for sealing a container 22 in a tamper-proof manner could be utilized such as wrapping the container in a printed paper which would evidence cuts, tears or other tampering or by providing an ink dye within the wall of the container which would rise to the surface of the container so as to be readily visible if the container were punctured, thereby releasing the dye within the wall of the container.

An important feature of the present invention, however, resides in the fact that the container 22 for the food or drug product has a dispensing opening 32 through which bottled or otherwise confined product within the container can be dispensed at the retail location 30 and in a manner such that once a product has been dispensed, it cannot be reinserted into the sealed container.

Figure 2:
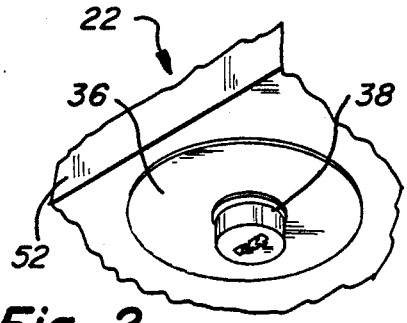
FIG. 2 is a fragmentary perspective view of the bottom of a container illustrating a closure unit positioned in the dispensing opening of the container.
Figure 3:
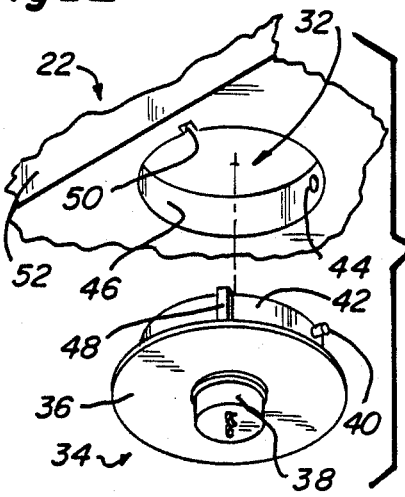
FIG. 3 is a fragmentary perspective view similar to FIG. 2 with the closure being removed from the dispensing opening.

For this purpose, the dispensing opening 32 in the container 22 must be sealed or locked in a closed condition at the packaging and/or manufacturing site 24 and not opened until the container is placed in a display location at the retail site 30. Several systems for sealing the dispensing opening 32 are shown in FIGS. 2 through 5 with FIGS. 2 and 3 illustrating a dispensing opening of generally cylindrical configuration and adapted to receive a key lock closure element 34 which totally seals and closes the dispensing opening until removed by an individual having the appropriate key for operating the lock. In the disclosed embodiment, the closure element 34 is also generally cylindrical in configuration having an enlarged face place 36 that slightly overlies a portion of the face of the container in which the dispensing opening is provided. A key lock 38 for the element operates a reciprocal latch or lock finger 40 which is adapted to protrude radially from the surface of the cylindrical body 42 of the element. The finger 40 is adapted to protrude into a mating hole 44 provided in the wall 46 of the dispensing opening 32. In order to align the finger with the hole 44, a guide rib 48 is provided on the cylindrical wall of the body 42 which is adapted to be received in an accomodating or mating slot 50 in the wall of the dispensing opening, so that when the guide rib is inserted into the slot, the finger 40 is aligned with the hole 44 so that operation of the key lock 38 with the appropriate key will cause the finger to protrude into the hole 44 or be retracted out of the hole as desired.

As illustrated in FIG. 2, when the closure element 34 is locked in place in the dispensing opening, the dispensing opening is totally sealed so that access to the interior of the container 22 and the products 20 retained therein cannot be had without access to the key for operating the lock. The wall 52 of the container 22 in which the dispensing opening 32 is provided may be reinforced with metal or plastic to assure that the closure element 34 is securely locked within the wall of the container in a tamper-proof manner.

Figure 4:
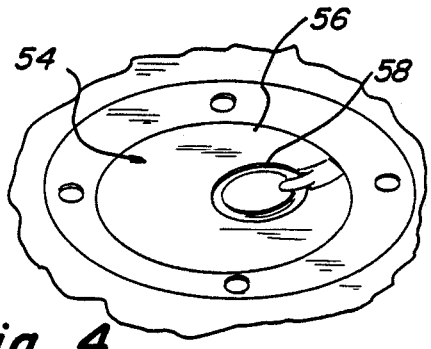
FIG. 4 is a fragmentary perspective view of a second embodiment of a closure unit illustrated in place in the dispensing opening of a container.
Figure 5:
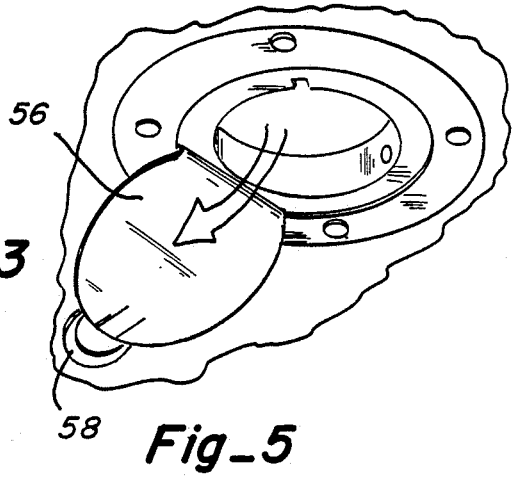
FIG. 5 is a fragmentary perspective view similar to FIG. 4 with the closure member being removed from the dispensing opening.
Figure 11:
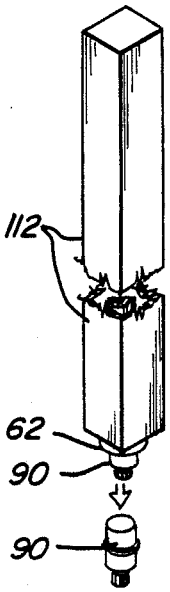
FIG. 11 is a perspective view with parts removed illustrating a carton in which bottle-type containers for food and drug products would be sealed in accordance with the method of the present invention.

A second embodiment of a closure element is illustrated in FIGS. 4 and 5 wherein the dispensing opening 32 in the wall of the container 22 is identical to that shown in FIGS. 2 and 3 for purposes which will become apparent later, but the opening 32 is covered prior to retail sales of the product 20 within the container 22 by a tear-away metal top 54 such as is found on numerous can-type containers. Such a tear-away top may be in the form of a metal lid 56 which is sealed around its perimeter to the container 22 so as to cover the dispensing opening 32 therein, but the connection between the tear-away lid 56 and the container is fragile so that it can be broken by grasping a loop tab 58 provided on the lid and pulling the tab as illustrated in FIG. 5 so as to sever the connection of the lid to the container. Obviously, if the closure element is not in its sealed condition illustrated in FIG. 4 when the container reaches the retail destination, it will be evident that the container has been tampered with and the products retained therein should not be sold.

As was mentioned previously, an important element of the method of the present invention is maintaining the integrity of the sealed container from the packaging and/or manufacturing location 24 to the retail sales location 30 but an equally important feature of the invention is to make sure that the contents of the container remain untampered with even after the dispensing opening of the container has been opened for retailing purposes.

In accordance with the invention, the closure element 34 is not removed from the dispensing opening until the container is ready to be placed at a display location at the retail site and at that point in time, a dispensing unit is locked into the dispensing opening 32 which is adapted to dispense product 20 from the container one at a time and in a manner such that the product cannot be reinserted into the container thereby avoiding the possibility of someone tampering with a product and then replacing it in the container for sale to an unsuspecting consumer.

Figure 6:
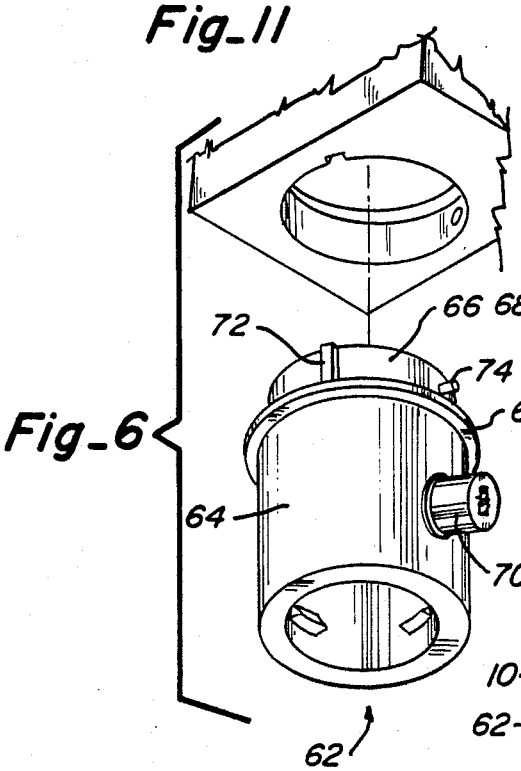
FIG. 6 is a fragmentary perspective view of a dispensing unit and the dispensing opening of a container in a separated relationship.
Figure 7:
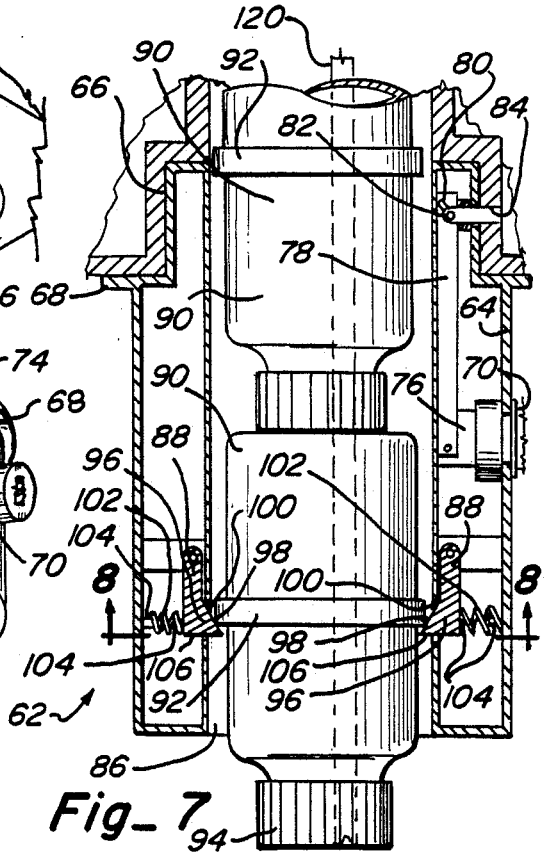
FIG. 7 is an enlarged section taken along line 7—7 of FIG. 12.

A first embodiment of a dispensing unit which could be utilized to dispense bottled or otherwise packaged food and/or drug products is illustrated in FIGS. 6 through 12 and as best seen in FIGS. 6 and 7 includes a hollow generally cylindrical element 62 having a main body portion 64 of hollow-walled cylindrical configuration with a relatively small upward cylindrical extension 66 separated from the main body 64 by a circular flange 68. The cylindrical extension 66 is adapted to matingly fit within the dispensing opening 32 of the container 22 and be secured therein with a key lock assembly 70 similar to that described in connection with the first described closure element 34. In other words, the cylindrical extension 66 has a raised elongated rib 72 adapted to be received in the slot 50 provided in the dispensing opening 32 whereby a reciprocating key-actuated lock finger 74 can be aligned with the hole 44 in the dispensing opening to selectively secure the unit within the opening.

As can be seen in FIG. 7, the key-actuated lock element 70 has an inner cylindrical element 76 that rotates upon rotative movement of a correct key therein. A push-pull bar 78 is attached to the inner cylindrical element 76 to reciprocally move up and down within the hollow walls of the main body 64 as the key in the lock is moved reciprocally between locking and unlocking positions. The upper end of the push-pull bar 78 has an angularly related cam slot 80 formed therein that receives a slide pin 82 passing through the inner end of the lock finger 74. The lock finger is slidably positioned within a cylindrical passage 84 in the extension 66 so that reciprocal movement of the push-pull rod by the key in the lock will cam the lock finger in a reciprocating linear manner so as to protrude into the hole 44 in the dispensing opening 32 or be retracted out thereof in accordance with the position of the key lock.

Near the lower end of the cylindrical passage 86 through the dispensing unit, a plurality of preferably three or more dispensing fingers 88 are pivotally mounted within the hollow interior of the walls so as to protrude into the passage 86 to selectively support a bottle or otherwise packaged food or drug product. For purposes of the present disclosure, the food or drug product is packaged in a cylindrical bottle 90 having a protruding circumferential rib 92 around its midsection with such a bottle being illustrated in FIGS. 7 and 9. The bottle 90 is dispensed from the container 22 in an upside-down manner so that the cap 94 of the bottle passes through the dispensing unit first.

The dispensing fingers 88 are elongated in configuration having an enlarged head 96 at their lower end with the head having a beveled cam surface 98 adapted to engage and support the circumferential rib 92 on the bottle. The dispensing fingers are pivotally supported at their upper end to move in and out of internal openings 100 provided in the inner wall of the dispensing unit 32 so that when they protrude into the passage 86, the bottle is supported as illustrated in FIG. 7 but when retracted into the hollow interior of the walls of the dispensing unit, the dispensing fingers do not inhibit the movement of the bottles so that they can pass through the passage and be removed from the container. The dispensing fingers are biased into the supporting position of FIG. 7 by coil springs 102 mounted on a pair of pins 104, one protruding inwardly from one of the walls of the dispensing unit and the other being located on the back side of the dispensing finger so that the coil spring 102 will remain in position and bias the dispensing fingers into their supporting position.

As will be appreciated, the cap 94 of the bottle protrudes out of the lower end of the dispensing unit so that it can be grasped by a consumer and pulled downwardly with the circumferential rib 92 camming the dispensing fingers outwardly out of the path of movement of the bottle. As soon as the circumferential rib has passed the dispensing fingers, however, they will again protrude into the passage 86 due to the bias placed thereon by the coil springs 102 and support the next following bottle in a similar manner. It is important to note that the cam surfaces 98 are directed upwardly so that a bottle cannot be reinserted into the container as an attempt to reinsert the bottle would merely cause the circumferential rib 92 to engage the flat bottom surfaces 106 of the dispensing fingers which will not cause the fingers to retract as would be necessary to reinsert the bottle into the container.

A plurality of the dispensing fingers are provided to make it more difficult to reinsert a bottle into the container by sticking one's fingers or a utensil into the passageway in an attempt to retract the dispensing fingers so that a bottle could be moved past the fingers and back into the container. Also, the fingers are positioned a sufficient distance from the lower open end of the dispensing unit so that they are not readily visible or accessible for tampering purposes.

Figure 10:
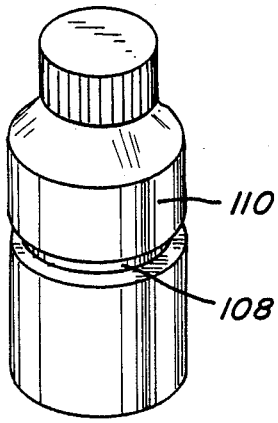
FIG. 10 is a perspective view of a different type of bottle for use in the method of the present invention.

The bottles might also take a configuration similar to that illustrated in FIG. 10 wherein a circumferential groove 108 is provided in the side wall of a bottle 110 rather than a protruding rib but as will be appreciated, the dispensing fingers 88 would cooperate with the groove 108 in a similar manner to the rib 92 to allow easy dispensing of bottled units one at a time but would prevent the reinsertion of such units. If a bottle 110 of the type illustrated in FIG. 10 were utilized, the degree to which the dispensing fingers 88 protrude into the passage 86 would be slightly greater than that illustrated in FIG. 7 so that the fingers would actually protrude into the circumferential groove 108 in order to support a bottle in a position ready for dispensing.

As will be appreciated, in order to properly dispense bottled or otherwise packaged products, the bottles must be positioned within the container so as to be fed in a single-file manner into the dispensing unit. This could be accomplished in several ways, with one such system being illustrated in FIG. 11 wherein the container 112 itself is merely an elongated box of slightly larger internal dimensions than the diameter of the bottle so that a single-file column of the bottles could be confined in a vertical stacked relationship for dispensing through the bottom of the container wherein the dispensing unit would be provided.

Figure 12:
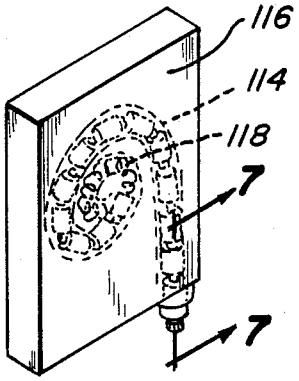
FIG. 12 is a perspective view of a second embodiment of a carton for dispensing the bottles of product in accordance with the present invention.
Figure 9:
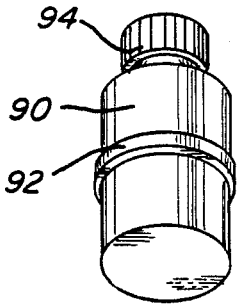
FIG. 9 is a perspective view of a bottle utilized in the method of the present invention for containing food or drug product.

A second embodiment is illustrated in FIG. 12 wherein a spiral channel 114 is provided within a container 116 with the bottled goods being axially aligned within the spiral channel which opens into the dispensing opening 32 at the bottom of the container. A biasing means possibly in the form of an expandable coil spring 118 would be positioned in the spiral channel so as to push the bottled products along the spiral channel as individual bottles are removed from the dispensing unit at the bottom thereof.

Another system of feeding individual bottles of product to the dispensing unit would include attaching a severable tape 120 or string to each bottle in a sequential manner so that as one bottle is removed from the dispensing unit the next bottle is pulled into a position for removal. Means for severing the tape (not shown) might be positioned immediately adjacent to the dispensing opening 32 so that the tape 120 can be easily severed. Reference to FIG. 7 illustrates the tape 120 in dashed lines passing from one bottle to the next and being connected thereto in any suitable manner.

Other systems for delivering bottles to the dispensing unit might include a gravity flow system (not illustrated) such as is used in many bottled soda dispensing machines.

Figure 15:
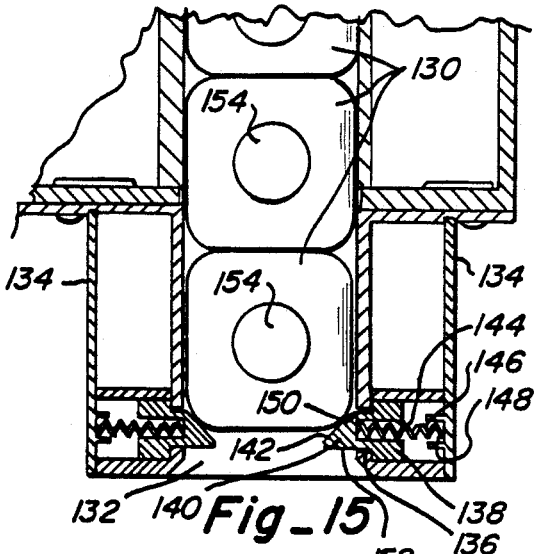
FIG. 15 is a section taken along line 15—15 of FIG. 14.
Figure 14:
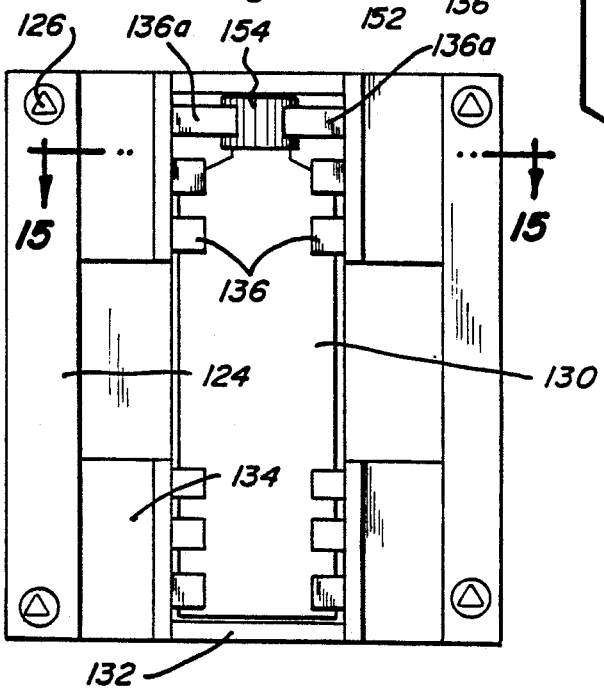
FIG. 14 is a bottom plan view of the dispensing unit shown in FIG. 13.
Figure 13:
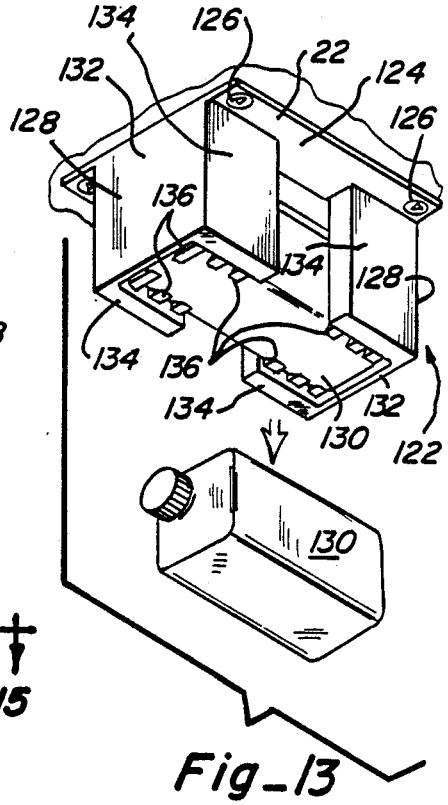
FIG. 13 is a perspective view of another embodiment of a dispensing unit in accordance with the present invention showing a bottle for food or drug products being dispensed therefrom.

As will be appreciated, the aforedescribed dispensing unit dispenses bottles which are axially aligned but the bottles might also be dispensed in lateral alignment utilizing a system of the type illustrated in FIGS. 13 through 15. The dispensing unit 122 illustrated in FIGS. 13 through 15 includes a base plate 124 which is attached to the bottom of a container 22 as by rivets 126 but it will be appreciated that a key lock system of the general type described in connection with FIGS. 6 through 12 might also be implemented. A pair of spaced generally U-shaped guides 128 of hollow construction depend integrally from the base plate 124 and form a rectangular passageway 128 through which bottle-type containers can be dispensed in a sequential manner. For purposes of illustration, the bottles 130 disclosed in association with the dispensing unit 122 of FIGS. 13 through 15 are of square cross-section but it will be readily appreciated that other bottle container configurations could be utilized such as for example a cylindrical container of circular cross-section which contains elongated protruding ribs or grooves in its side walls (not shown).

Each U-shaped guide 128 has a base 132 and a pair of opposing legs 134 which, as mentioned previously, are of hollow construction whereby in each leg 134, a plurality of dispensing fingers 136 are mounted for reciprocating movement. The dispensing fingers each have a base 138 of square cross-section and a protruding head 140 which is also of square cross-section but including one beveled cam surface 142 that inclines upwardly and forms an engaging surface for supporting a stack of bottles 130 passing through the dispensing unit. The rear face of each dispensing finger has a recess 144 formed therein adapted to seat one end of a coil spring 146 whose other end is seated in a pocket 148 formed by a circular rib which serves to retain the coil spring in a fixed position wherein it is adapted to bias the associated dispensing finger through a square opening 150 provided in an internal wall of an associated leg 134. In the embodiment disclosed, there are three dispensing fingers 136 in each leg of each guide member totalling twelve fingers making it difficult for anyone to retract all twelve fingers while inserting a bottle into the unit. This, of course, renders the system more tamper-proof in that bottles cannot be reinserted into the container by forcing them against the retention fingers due to the fact that each finger has a flat bottom surface 152 that prevents retraction of the finger upon pressure being applied thereto. However, as will be appreciated, the lowermost bottle in a stack of bottles in the container can be grasped by gripping the bottle between the U-shaped guides 128 and pulling the bottle downwardly which places a camming force on the dispensing fingers forcing them to retract and allow passage of a single bottle. As soon as the bottle has been removed, however, the dispensing fingers will be urged back into the passageway to restrict movement of the next succeeding bottle until an adequate amount of force is applied thereto to overcome the spring bias placed on the dispensing fingers. As best seen in FIG. 14, one pair of dispensing fingers **136*a* at the end of the dispensing unit adjacent the cap 154** of the bottle are somewhat longer to underlie the cap.

It will therefore be seen that in each embodiment of the dispensing unit, individual bottles of food or drug products can be dispensed one at a time through the dispensing unit and in a manner such that they cannot be reinserted into the dispensing unit or the container. Accordingly, the container itself is fully tamper-proof due to the fact that it is otherwise completely sealed on all sides and the only access to the interior of the container is through the dispensing opening and the dispensing unit.

According to the aforedescribed method, it will be seen that the container 22 for the food and drug products is sealed either at the manufacturing and/or packaging site and is not opened until the container is ready to be placed on a display shelf at the retail site and then only the dispensing opening is opened by an authorized employee who immediately mounts the dispensing unit on the container in a tamper-proof manner. Since the dispensing units themselves are tamper-proof, the products are handled in a tamper-proof manner from the time they are containerized to the time they are individually selected by a consumer so that no tampering is possible.

It is also consistent with the present invention that the dispensing unit be incorporated into the container when the container is sealed with product so that a closure unit is not necessary. This system would probably not be as economical as the systems previously described as there would need to be one dispensing unit per container rather than one dispensing unit which is transferable between containers.

Although the present invention has been described with a certain degree of particularity, it is understood that the present disclosure has been made by wa of example, and that changes in detail or structure may be made without departing from the spirit of the invention, as defined in the appended claims.

I claim:

1. A tamper-proof method for distributing products manufactured at a manufacturing plant and shipped to a retail location comprising the steps of sealing the products at the manufacturing plant in a container having a dispensing opening through which the products can be removed, said dispensing opening having removable tamper-proof sealing means whereby access to the interior of the container is prevented, shipping the container to a retail location, removing the tamper-proof sealing means at the retail location, and locking dispensing means to the container at the dispensing opening with the dispensing means being adapted to permit the removal of products from the container while preventing the insertion of products into the container.

2. The method of claim 1 wherein said tamper-proof sealing means consists of a closure which once removed cannot be reused to seal the container.

3. The method of claim 1 where said dispensing means is locked to the container through the use of latch means forming a part of both said dispensing opening and said tamper-proof sealing means, and a lock mechanism adapted to selectively secure the latch means.

4. The method of claim 3 wherein said lock mechanism is a key operated lock mechanism.

5. The method of claim 1 said dispensing means permits the removal of one product at a time.

6. The method of claim 1 wherein said dispensing means has a passage therethrough in communication with the interior of aid container and a plurality of fingers protruding into said passage which allows the products to move out of the container but prevents the product from being inserted into the container through said dispensing means.

7. The method of claim 6 further including means on said products for cooperating with said fingers to retain the product in a position for ready removal from the container.

8. The method of claim 1 wherein said container further includes feed means for feeding products to said dispensing means.

9. The method of claim 8 wherein said feed means urges the products to move by gravity into said dispensing means.

10. The method of claim 8 wherein said feed means includes biasing means for urging products toward the dispensing means.

11. The method of claim 8 wherein said feed means includes a severable ribbon attached sequentially to each product in the container whereby removal of one product from the dispensing means will pull a subsequent product into the dispensing means.

* * * * *